United States Patent [19]

Holden et al.

[11] 4,058,165

[45] * Nov. 15, 1977

[54] WELLBORE CIRCULATING VALVE

[75] Inventors: John C. Holden; Gary Q. Wray, both of Duncan, Okla.

[73] Assignee: Halliburton Company, Duncan, Okla.

[ * ] Notice: The portion of the term of this patent subsequent to Nov. 26, 1991, has been disclaimed.

[21] Appl. No.: 625,433

[22] Filed: Oct. 24, 1975

Related U.S. Application Data

[62] Division of Ser. No. 513,928, Oct. 10, 1974, which is a division of Ser. No. 288,187, Sept. 11, 1972, Pat. No. 3,850,250.

[51] Int. Cl.[2] ..... E21B 43/00

[52] U.S. Cl. ..... 166/314; 166/224 R; 251/58

[58] Field of Search ..... 166/224 R, 314, 128, 166/134, 184, 72, 68, 147, 814; 251/58

[56] References Cited

U.S. PATENT DOCUMENTS

| | | | |
|---|---|---|---|
| 2,951,536 | 9/1960 | Garrett | 166/184 X |
| 3,132,703 | 5/1964 | Larcen | 173/77 X |
| 3,306,366 | 2/1967 | Muse | 166/128 X |
| 3,395,758 | 8/1968 | Kelly et al. | 166/224 R X |
| 3,433,301 | 3/1969 | McEver, Jr. | 166/128 |
| 3,572,434 | 3/1971 | Ecuer | 166/147 |
| 3,583,481 | 6/1971 | Vernotzy | 166/224 R X |
| 3,741,305 | 6/1973 | Young | 166/.5 X |
| 3,805,894 | 4/1974 | Giroux | 166/314 |

*Primary Examiner*—Ernest R. Purser
*Assistant Examiner*—Richard E. Favreau
*Attorney, Agent, or Firm*—Floyd A. Gonzalez; James E. Cockfield; John H. Tregoning

[57] ABSTRACT

A wellbore circulating valve especially useful in a string of testing tools utilizes a sequentially ratcheted inner mandrel which covers a series of flow ports and is opened by a predetermined sequence of operations which move the mandrel away from the flow ports thereby communicating the annulus with the inner bore of the tool.

9 Claims, 8 Drawing Figures

FIG. 1b

WELLBORE CIRCULATING VALVE

RELATED APPLICATIONS

This is division of application Ser. No. 513,928, filed Oct. 10, 1974 which is itself a division of application Ser. No. 288,187, filed Sept. 11, 1972, now U.S. Pat. No. 3,850,250 issued Nov. 26, 1974.

BACKGROUND OF THE INVENTION

After an oil well has been encased and cemented it usually becomes desirable to test the formations penetrated by the wellbore for possible production rates and general productivity of the well. In doing so, a test string containing several different types of tools is utilized to indicate the productivity of the well. These tools may include a pressure recorder, a sample chamber, a closed-in pressure tester, hydraulic jar, one or more packers, and several other tools. In addition, it is preferable to include one or more circulating valves in the string.

The testing procedure requires the opening of a section of the wellbore to atmospheric or reduced pressure. This is accomplished by lowering the test string into the hole on drill pipe with the tester valves and sample chambers closed to prevent entry of well fluid into the drill pipe. With the string in place in the formation, packers are expanded to seal against the wellbore or casing and isolate the formation to be tested. Above the formation the hydrostatic pressure of the well fluid is supported by the upper packer. The well fluid in the isolated formation area is allowed to flow into the drill string by opening the tester valve. Fluid is allowed to continue flowing from the formation to measure the ability of the formation to produce. The formation may then be "closed in" to measure the rate of pressure buildup.

After the flow measurements and pressure buildup curves have been obtained, one or more samples can be caught and then the test string will be removed from the well.

At this point the importance of the circulating valve becomes important. Since it is not desirable to pull the testing string while it may still be full of formation fluids and/or high pressure gas due to the danger of explosion and fire at the surface, plus the resulting contamination of the rig and rig floor with the crude oil and other formation fluids which leads to dangerous and slippery footing, it is almost mandatory that the formation fluids be reversed out under controlled conditions and bled-off away from the rig floor.

To accomplish this reversing out, the inner bore of the test string and drill pipe must be opened near the test tools so that displacement fluid (usually drilling mud) from the annulus can flow into the string to force out the formation fluids at the top where they can be piped away from the rig. The hydrostatic pressure from the displacement fluid is usually considerably higher than the formation pressure due to the high density of the mud and the height of the mud column in the well, therefore displacement from the annulus into the string and up to the surface usually occurs without the need for pumping. All that is required is that the annulus be placed in fluid communication with the bore of the test string at the proper time. During testing and sampling operations the hydrostatic fluids in the annulus must be isolated from the formation fluids to prevent contamination of the tests and samples.

Thus, it is only after the testing and sampling is completed that it is desirable to reverse out the remaining formation fluids in the tubing.

Several methods of accomplishing this are currently in use. One of these methods involves covering the ports through the tubing wall with an inner sleeve which is shear pinned to the tubing wall. When the sleeve is to be opened a weighted bar is dropped through the tubing to strike the sleeve and shear the pins, moving the sleeve downward to uncover the ports and communicate the annulus with the tubing bore. The disadvantages of this device are obvious; a deviated hole may cause the bar to bind in the tubing thereby blocking the tubing and preventing opening of the circulating valve sleeve and removing any chance of reversing out. Also slant holes may reduce the speed of the bar moving down the tubing because of friction between the bar and the tubing wall. A reduction in speed could lower the striking force of the bar to the point where the shear pins will not break and reversing out will not be possible. Also when some of the extremely heavy formation fluids are being recovered the bar may not be heavy enough in these fluids to shear the pins in the circulating valve, or there may be enough trash collected in the valve sleeve to cushion the impact of the bar and prevent shearing of the pins.

Other types of circulating valves utilize reciprocal or rotational movement to operate the valve sleeve. The rotationally operated circulating valve suffers from the disadvantage that often the string may bind in the well bore so that the string has enough flexibility to allow rotation by twisting above the circulating valve. The operator at the surface may have no way of knowing that the rotation is not accomplishing the desired effect, or if he knows he may have no way of correcting it. The same defect occurs in the reciprocating tools, they may become lodged in a deviated well and the circulating valve becomes inoperable.

In addition, the above described circulating valves are unsatisfactory in offshore wells because the blowout preventers must be opened in order to manipulate the drill string or drop the opening bar into the pipe in order to open the circulating valve. This becomes extremely dangerous because well blowout, explosion, and fire become a possibility when the blowout preventers are released and this remains a constant threat until the preventers are closed.

The apparatus of this invention overcomes these difficulties by opening in response to controlled fluctuations in annulus pressure, requiring no manipulation nor activating members inserted onto the tubing.

DESCRIPTION OF THE PREFERRED EMBODIMENTS

Figure 1A:
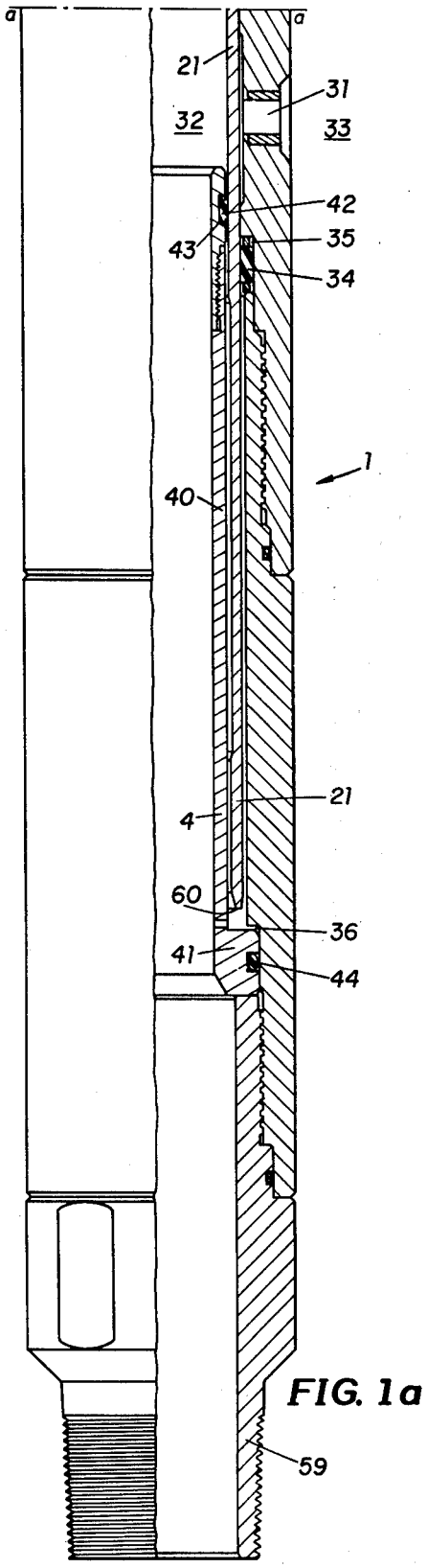
FIGS. 1*a*–1*f* joined along the illustrated connected lines illustrate a partial cross sectional view of the apparatus of this invention.
Figure 1B:
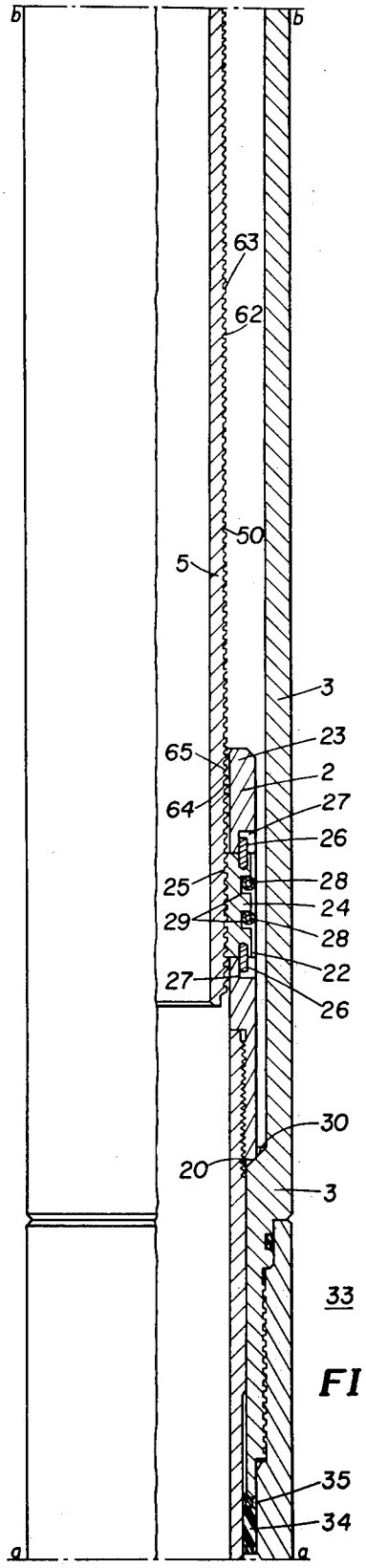
Figure 1C:
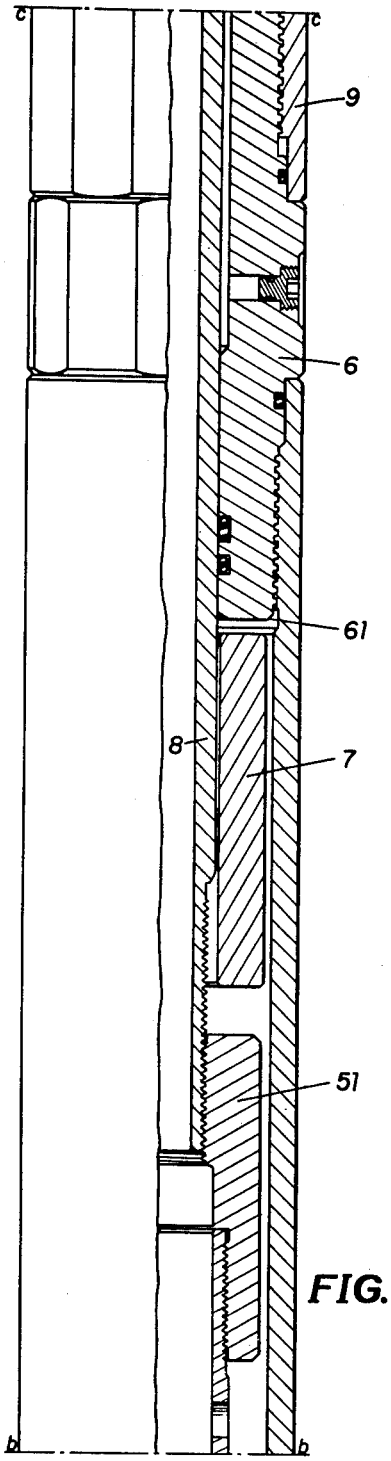

FIGS. 1*a*–1*f* depicts the preferred embodiment of the circulating valve apparatus 1 in which a tubular latch mandrel 2 is concentrically and slidably located inside a segmented tubular housing 3. Mandrel 2 has an external beveled shoulder 20 for engaging an internal beveled shoulder 30 in housing 3. This limits downward movement of mandrel 2 in housing 3. Housing 3 has one or more ports 31 through the wall thereof which communicate from the inner bore 32 of housing 3 to the annular area 33 between the tool 1 and the well casing.

In its lowermost position, skirt 21 of latch mandrel 2 covers ports 31 and prevents fluid communication therethrough. Circular seals 34 located in internal grooves 35 of housing 3 provide fluid-tight seals between housing 3 and mandrel skirt 21 above and below ports 31.

Valve sleeve 4 is a tubular sleeve having an upper skirt 40 and a lower flanged end 41, with the skirt 40 being slidably located coaxially inside the latch mandrel skirt 21 and having a circular seal 42 located in annular groove 43 for providing a fluid-tight seal between skirt 21 and skirt 40. Flanged end 41 extends out of mandrel skirt 21 and is enlarged greater than the OD of skirt 21 to prevent skirt 21 from sliding over the flanged end. Abutment of skirt 21 on flanged end 41 limits downward movement of mandrel 2. Flanged end 41 is further extended into an inner annular recessed groove 36 in housing 3 which prevents upward or downward movement of valve sleeve 4 in housing 3. A circular seal 44 is located annularly around flange 41 to provide fluid-tight sealing contact with housing 3.

Latch mandrel 2 has one or more windows 22 through the wall thereof near the upper end 23 of the mandrel. Located in windows 22 are curved latch blocks 24 having curved internal threaded surfaces 25 located on their inward faces. Retainer pins 26 are fixedly attached to the edges of latch blocks 24 and arranged to abut recessed shoulders 27 of windows 22 to limit inward movement of blocks 24 in windows 22.

Latch blocks 24 are arranged to move outwardly from windows 22 in response to wedging forces pushing them outward. Spring elements 28 encircle blocks 24 in grooves 29 and latch mandrel 2 and provide a spring force tending to press blocks 24 inwardly in windows 22 thereby providing a constant but yieldable restraining force thereon.

Figure 3:
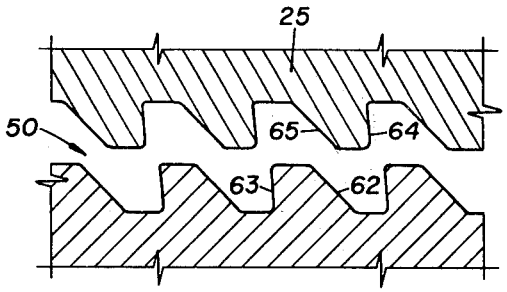
FIG. 3 is a blown-up cross sectional view of the threads on the latch mandrel and pull mandrel.

Pull mandrel 5 is a tubular cylindrical sleeve located concentrically within the latch mandrel 2, having a helical thread 50 which engages and matches the helical thread 25 inside latch blocks 24. Alternatively, instead of theads at 25 and 50, circular parallel grooves could be used in the latch blocks and on mandrel 5. Referring now to FIG. 3, threads 50 have a sloped face 62 on their lower leading edge and a slightly sloped face 63 on their upper trailing edge. Threads 25 have a slightly sloped face 64 on their lower edge and a sloped face 65 on their upper edge. This allows downward longitudinal movement of pull mandrel 5 through latch mandrel 2 by means of wedging action of the sloping face of threads 50 on the sloping face of threads 25, which wedging action forces latch blocks 24 outward and allows telescopic movement of mandrel 5 into mandrel 2. The weding forces required to move latch blocks 24 outward and allow mandrel 5 to telescope into mandrel 2 must necessarily be less than those holding mandrel skirt 21 in position in housing 3, which are the friction forces of seal rings 34 and 42.

Upward movement of pull mandrel 5 results in abutment of the backwardly sloped faces 63 and 64 of threads 50 and 25 which results in likewise upper movement of latch mandrel 2. A subsequent downward movement of pull mandrel 5 into latch mandrel 2 achieves another wedging outward of latch blocks 24 and allows the pull mandrel to take another "bite" on the latch mandrel, and through this ratcheting type of action, will allow a sequential train of upward and downward movements of the pull mandrel to result in a complete extension of the latch mandrel and skirt out of the annular area between the valve sleeve 4 and housing 3.

Faces 63 and 64 of threads 50 and 25 respectively are illustrated having a slight back slope of around 2° to 10°, with a preferable angle of about 5°. This provides a positive locking engagement of threads 50 and 25 when they are moving in such a relationship, one to the other, that faces 64 are abutted with faces 63. It is contemplated that the back angle of faces 63 and 64 with the vertical in FIG. 3 may be anywhere from 0° to 60° and the forward angle of faces 62 and 65 may be from about 10° to about 75° with the vertical.

A preferred angle for faces 62 and 65 for optimum strength and good wedging action appears to be around 45°.

Upward travel of the latch mandrel about the pull mandrel will be limited by abutment of the upper mandrel end 23 with exterior annular shoulder 51 attached to the pull mandrel. Shoulder 51 may be an integrally formed shoulder or can be a threaded collar fixedly attached to the upper end of mandrel 5.

Threadedly attached to the upper end of housing 3 is adapter 6 which has an internally projecting shoulder 61. This shoulder may be formed by machining adapter 6 with a smaller ID than that of the housing at the point where they are threadedly attached. Spacer 7 is slidably located within housing 3 and around the upper extension mandrel 8 so that upward travel of the pull mandrel is limited by abutment of shoulder 51, spacer 7, and shoulder 61.

Figure 1D:
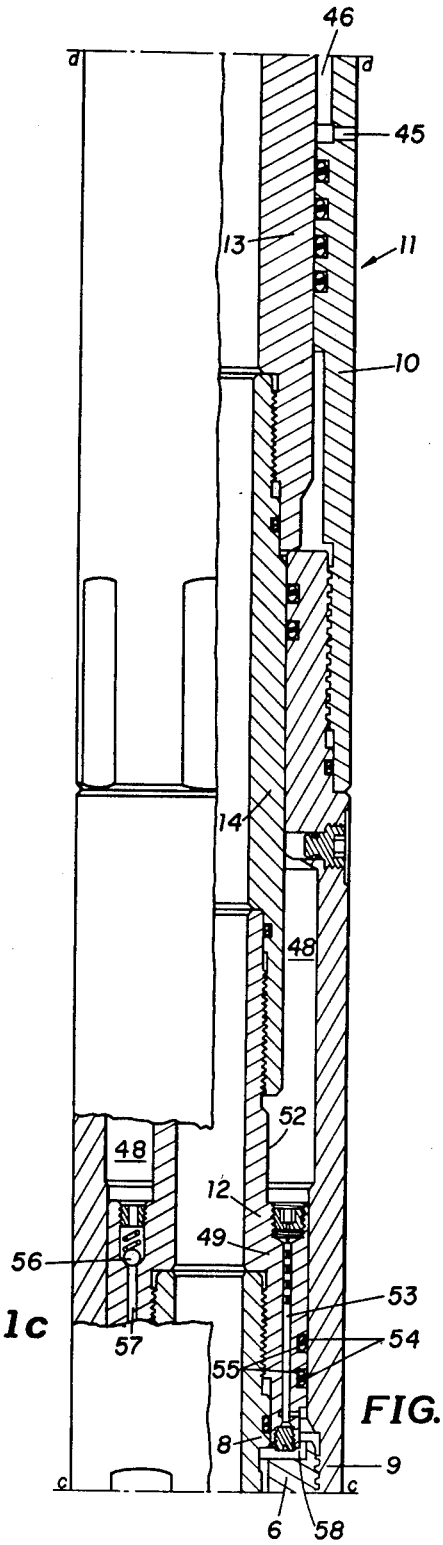
Figure 1E:
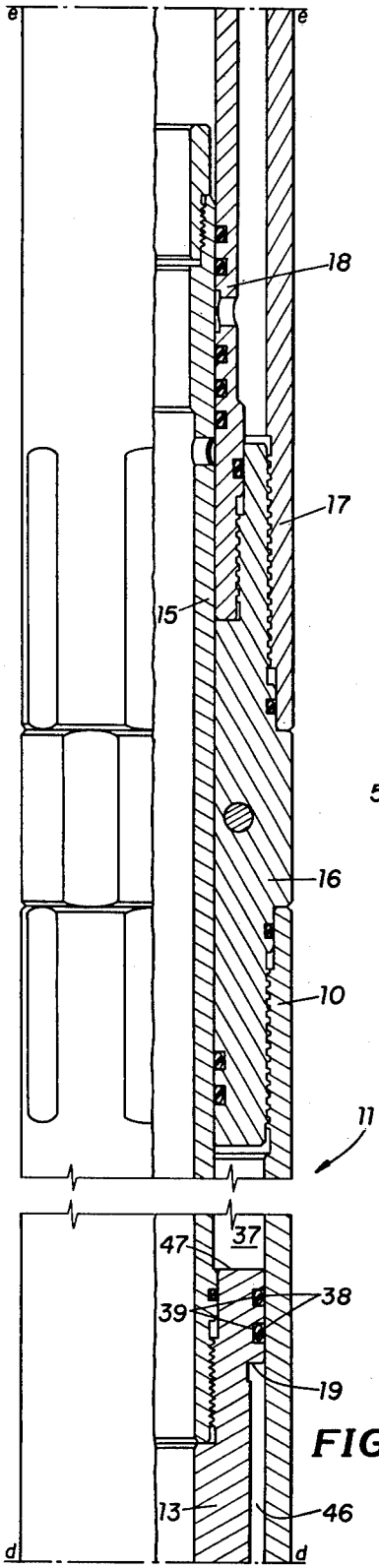
Figure 2:
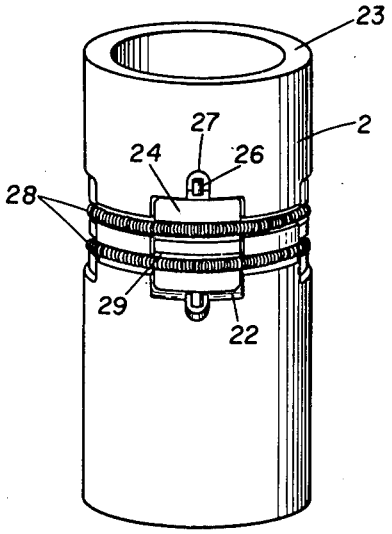
FIG. 2 is an elevational view of the latch mandrel showing the orientation of the latch blocks.
Figure 1F:
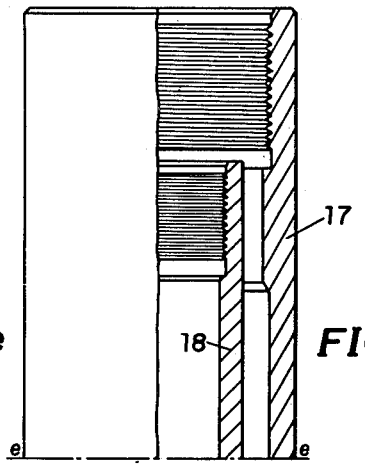

Referring to FIGS. 1d to 1f which are continuations of FIG. 1 and show the apparatus broken in order to more easily locate the drawings on the page in as large a detail as possible, adapter 6 is shown threadedly engaged in the intermediate housing 9 which, in conjunction with upper housing 10, contains the power section 11 for actuating the valve section 1.

Extension mandrel 8 extends upwardly through adapter 6 and intermediate housing 9 and is threadedly engaged in the cylindrical orifice mandrel 12. A cylindrical piston mandrel 13 is fixedly attached to the upper end of orifice mandrel 12 via lower section 14 and has an extended upper skirt section 15.

Adapter collar 16, having a narrowed ID, is threadedly secured to upper housing 10 and has an exterior tubular extension 17 threadedly attached to its upper end, and concentric inner extension 18 fixedly attached interiorly thereto.

Thus, it can be seen in FIGS. 1d and 1e that the power section generally consists of a stationary outer casing and a slidable inner member, with the outer casing consisting substantially of adapter 6, intermediate housing 9, upper housing 10, adapter collar 16, tubular extension 17, and inner extension 18. The slidable inner member consists of extension mandrel 8, orifice mandrel 12, piston mandrel 13, lower section 14, and upper skirt 15.

A differential piston arrangement is provided by differential piston area 19 on the upper end of piston mandrel 13. This area works in conjunction with piston chamber 37 to provide a power actuating source for the power section 11. Piston chamber 37 is formed by the relatively large inner diameter of housing 10 and the narrow inner diameters of adapter collar 16 and housing 10. A gas-tight seal is provided by circular seals 38 located in exterior annular grooves 39 on piston mandrel 13. Power fluid access to the differential piston area 19 is achieved through one or more ports 45 through the wall of upper housing 10, communicating with annular space 46 between the enlarged upper section of piston mandrel 13 and housing 10. Piston chamber 37 is shown in broken construction to reduce the length of the drawing. In actuality, it is considerably longer than pictured and can be made of any variable length which results in sufficient volume to provide the desired spring effect. In one embodiment, this chamber comprises approximately one-half of the length of the power section and contains an inert gas under pressure to provide a return force on face 47 of piston mandrel 13 so that after the pressure is removed from the actuating fluid in area 46 the compressed gas in chamber 37 forces piston mandrel 13 back down to its initial lower position.

A mechanical spring can be used in place of or in conjunction with the inert gas in chamber 37 to vary the restoring force on piston 14. This variance can also be obtained by either varying the initial pressure of inert gas in chamber 37 or by varying the volume of chamber 37, or by both means.

Actuating force can be varied by increasing or decreasing the differential area 19 of piston 13 by reducing the OD of piston 13 below face 19, or by increasing the ID of housing 10 and the OD of piston face 19, or by both methods.

Sharp upward movement of the inner member within the outer members is prevented by the reaction of the orifice mandrel in the dampener chamber 48. The orifice mandrel 12 has an integral orifice collar 49 which moves slidably in annular chamber 48 formed between housing 9 and the narrowed section 52 of mandrel 12. Chamber 48 is filled with some durable non-corrosive fluid such as hydraulic oil and is a fluid-tight sealed chamber. As mandrel 12 moves upward in hosuing 9, collar 49 must traverse sealed chamber 48 which is filled with fluid. To do so, the fluid above the collar must traverse through orifice channel 53 to below the collar. Circular seals 54 located in grooves 55 in collar 49 seal against the inside of housing 9 and prevent leakage of fluid around collar 49. The effect of moving collar 49 through chamber 48 and allowing fluid to flow only through the restricted orifice channel is that movement of the inner mandrels in the outer housing is dampened to prevent sudden large movements therein. As the movement actuating force increases, the dampening force of the orifice arrangement increases correspondingly.

When the actuating force on piston face 19 is removed, it is desirable that the mandrels 12 and 13 be allowed to move downward relatively unrestricted so a bypass check valve arrangement is provided at 56 to allow fluid to flow from the lower side of collar 49 through channel 57 to the upper side in chamber 48 relatively unhindered, thereby bypassing orifice channel 53. This is provided since the spring constant of the gas spring in chamber 37 is preset at a non-excessive level to prevent damage to the apparatus through sudden sharp return of the piston mandrel to its initial position. Channels 53 and 57 are in continuous fluidic communication with the lower side of collar 49 through chamber 58 which is an annular chamber passing completely around the exterior circumference of the extension mandrel 8. Likewise, chamber 48 is an annular chamber completely surrounding mandrel 8. There may be one or more orifice channels 53, and one or more bypass channels 57.

In operation the entire apparatus is connected into a testing string, for instance, by threading the upper ends of extensions 17 and 18, and the threaded lower end 59 of the valve section 1 into the test string.

The string can then be lowered into the hole and the formation tested. The use of this apparatus is particularly advantageous in conjunction with the annulus pressure operated sampler disclosed in U.S. Pat. No. 3,664,415. The advantages of pressure operated tools are particularly felt when operating in an offshore well where it is highly preferable to maintain the blowout preventer rams closed at all times which naturally prevents any type of manipulation of the test string to operate the various tools in the well. The types of manipulations commonly used are rotation and reciprocation or combinations of the two, all of which cannot be performed with the blowout preventers in place.

Therefore, the tool of this invention is extremely safe and advantageous for use in offshore wells and unpredictable high pressure inland wells. When the tool string is in place in the well and the blowout preventers are closed in on the testing tools the sampler can be activated by applying hydraulic pressure to the annulus between the tool string and the casing.

The increase in annulus pressure reacts through ports 45 and against differential area 19, forcing piston mandrel 13 upward against the spring means in chamber 37. As the piston mandrel moves upward it simultaneously pulls orifice mandrel 12, extension mandrel 8, pull mandrel 5, latch mandrel 2 and skirt 21 upward until shoulder 51 contacts spacer 7, thereby preventing any further upward movement of the inner mandrel section. After the testing or other operations in the various parts of the string have been completed, the annulus pressure is removed and the spring means in chamber 37 forces the inner mandrel system back down to its initial position by working aginast piston face 47. Upon this downward return movement, pull mandrel 5 is extended into latch mandrel 1, thereby accomplishing the ratcheting action described beforehand. Then when another testing operation is required and the annulus pressure is again increased, the mandrels are moved upward another increment. The number of sequential pressure variations in the annulus fluid required to open the circulating valve 1 can be determined by the total length upward the latch mandrel must move to expose ports 31, divided by the incremental amount of mandrel moves during each individual pressurization of the annulus fluid. For instance in one embodiment, the latch mandrel must move ten inches to expose the circulating valve ports 31 and each incremental advance is limited to one inch, therefore to actuate the circulating valve the annulus must be pressured ten times. This allows the annulus to be pressurized nine times to perform other testing operations through the other tools in the string without actuating the circulating valve, which preferably is opened after the completion of all testing and sampling, immediately prior to removing the test string from the well.

The number of pressure variations required to open the circulating valve can easily be varied by several methods. For instance, lengthening spacer 7 will reduce the length of the increments and require more increments to accomplish the opening. Should it be desirable to reduce the numer of increments the spacer 7 could be shortened to increase the incremental travel of latch mandrel 2 upward.

The number of increments could also be varied by varying the distance between ports 31 and the lower end of skirt 21 by either moving the position of ports 31 up or down in the housing 3 and/or varying the length of the skirt 21 extending below ports 31.

Another feature of the circulating valve of this invention is the immediate responsive opening. When the final upward increment of the skirt 21 is achieved to open ports 31, the lower end of skirt mandrel 21 is pulled out of contact with the lowermost seal 34 allowing high pressure annulus fluid to flow almost instantaneously into the space below skirt 21 between housing 3 and valve sleeve 4. This fluid is prevented from entering the bore by contact of skirt 21 with upper seal 34 and seal 42. Thus, the high pressure fluid reacts against the bottom face 60 of the lower end of skirt 21, which face 60 acts as a differential pressure area between the high pressure annulus fluid and the relatively low pressure in the inner bore 32. This results in a "slamming" upward of the latch mandrel which assures a fully opened immediately responsive circulating valve.

It should be reemphasized that for proper operation of the circulating valve, springs 28 should not be any stronger than what is required to maintain latch blocks 24 in threaded engagement with pull mandrel 5 when it is moving upward. Thus, downward movement of pull mandrel 5 into latch mandrel 2 will be possible without sliding the latch mandrel downward because the frictional retaining force of seals 34 and 42 is substantially larger than the force required to push mandrel 5 through the latch blocks in mandrel 2.

Although a specific preferred embodiment of the present invention has been described in the detailed description above, the description is not intended to limit the invention to the particular forms or embodiments disclosed herein, since they are to be recognized as illustrative rather than restrictive and it will be obvious to those skilled in the art that the invention is not so limited. For example, while the circulating valve is described in combination with pressure operated actuating means, it is clear that other actuating means could be employed without need for modifying the circulating valve. For instance, a reciprocating actuator could replace the power section 11 and be attached to pull mandrel 5. Vertical reciprocation of the test string from the surface would serve to move the pull mandrel up and down in the latch mandrel just as the power section does with the same resulting ratcheting action which moves the mandrel out of its covering position over ports 31.

Likewise, a rotational actuating means could be utilized in conjunction with the circulating valve to move mandrel 2 upward in the housing 3. Since the mating threads in the latch blocks 24 and on pull mandrel 5 are preferably formed as normal helical threads, it is clear that rotating the pull mandrel by any normal means of rotation, such as for instance rotating the test string at the surface, would result in the latch mandrel being threaded upward or downward onto the pull mandrel. The only modification required for this type of operation would be to spline or pin the latch mandrel in housing 3 against rotational movement with respect to housing 3. This limiting means would serve only to prevent rotational movement and not longitudinal axial movement of the latch mandrel. Thus, the invention is declared to cover all changes and modifications of the specific example of the invention herein disclosed for purposes of illustration, which do not constitute departures from the spirit and scope of the invention.

What is claimed is:

1. A circulating valve for use in an oil well extending from the surface of the earth comprising:
   - normally closed valve means movable from a closed position to an open position;
   - opening means being arranged to produce a plurality of movements in said valve means for moving said valve means toward said open position, wherein said valve means is opened only upon the last movement of said plurality of movements being effected; and
   - means in said opening means for setting the number of movements produced in said plurality of movements before said valve means is opened.

2. The circulating valve of claim 1 wherein said opening means includes means responsive to an oil well parameter for producing said plurality of movements responsive to changes in said oil well parameter where said parameter changes are effected by well equipment at the surface of the earth.

3. A circulating valve for communicating the bore of a pipe string extending into a well bore from the surface of the earth with the area exterior to said pipe string, said valve comprising:
   - a tubular cylindrical outer housing having at least one port through the wall thereof;
   - means for connecting said housing between two sections of said pipe string;
   - mandrel means slidably located within said housing and arranged to sealingly cover said port in a first position, and uncover said port in a second position; and
   - opening means connected to said mandrel for producing a plurality of movement of said mandrel means wherein said mandrel means is incrementally moved from said first position to said second position such that said port is sealingly covered by said mandrel means during said plurality of movements, and said port is uncovered only upon the last movement of said plurality of movements.

4. The circulating valve of claim 3 further comprising means for limiting the amount of travel of each movement of said mandrel means thereby setting the number of movements in said plurality of movements for moving said mandrel from said first position to said second position.

5. The circulating valve of claim 3 wherein said opening means includes means responsive to an oil well parameter for producing said plurality of movements responsive to changes in said oil well parameter where said parameter changes are effected by well equipment at the surface of the earth.

6. A circulating valve adapted for connection into a testing string having an open interior means and operable to be located in a fluid filled bore of a well extending from the surface of the earth wherein said well includes surface equipment operable to change a parameter in said well, said circulating valve comprising:
   - normally closed valve means for preventing fluid communication between fluid in a well annulus and fluid in said open interior means when said valve means is in a closed condition, and for communicating a portion of said open interior means of said string with said well annulus when said valve means is in an open condition;

opening means operable for incrementally moving said normally closed valve means by a plurality of movements to said open condition, wherein said valve means remains in the closed condition until after a predetermined minimum number of said incremental movements; and, operating means, responsive to changes in said well parameter, for operating said opening means wherein each of said parameter changes responsively results in an incremental movement in said valve means.

7. The circulating valve of claim 6 further comprising means for changing the number of movements in said predetermined minimum number of incremental movements.

8. A method of reverse circulating a displacement fluid through a flow passage in a test string in an oil well bore, comprising the steps of:

providing at least one port in the test string for communicating an area of the well bore surrounding the test string with the flow passage in said test string;

sealingly covering said port with a slidable mandrel in said test string thereby closing said port;

incrementally moving said mandrel by a plurality of movements from said position closing said port to a position opening said port;

upon the last movement of said plurality of movements, opening said port thereby alowing communication between the area of the well bore surrounding the test string with the flow passage in said test string; and flowing said displacement fluid through said opened port thereby effecting reverse circulation through the flow passage in said test string.

9. Apparatus for use in testing well formations comprising:

actuating means responsive to hydraulic pressure for producing vertical reciprocal motion for an indefinite number of times;

valve means responsive to vertical reciprocal motion and arranged to control fluid communication from an annulus area exterior to a test string through said valve means to an open bore within a test string; and means for connecting said actuating means to said valve means, said means for connecting being capable of transferring movement produced by said actuating means to said valve means and being capable of opening said valve means only after a predetermined number of motions of said actuating means.

* * * * *

UNITED STATES PATENT AND TRADEMARK OFFICE

CERTIFICATE OF CORRECTION

PATENT NO. : 4,058,165

DATED : November 15, 1977

INVENTOR(S) : John C. Holden and Gary Q. Wray

It is certified that error appears in the above-identified patent and that said Letters Patent are hereby corrected as shown below:

Column 6, line 43, the number "1" should be --2--

IN THE CLAIMS

In claim 3 at column 8, line 36, after "mandrel" insert --means--

In claim 3, column 8, line 37, "movement" should be --movements--

Signed and Sealed this

*Sixth* Day of *June 1978*

[SEAL]

*Attest:*

RUTH C. MASON
*Attesting Officer*

DONALD W. BANNER
*Commissioner of Patents and Trademarks*